United States Patent [19]

Svenning

[11] 4,255,076

[45] Mar. 10, 1981

[54] LOADING APPARATUS WITH EXTENSION BOOM (TELESCOPIC BOOM) AND WITH HYDRAULIC LINES CARRIED BY THE BOOM

[75] Inventor: Sven Svenning, Partille, Sweden

[73] Assignee: Jonsereds AB, Sweden

[21] Appl. No.: 808,925

[22] Filed: Jun. 22, 1977

[30] Foreign Application Priority Data

Jun. 23, 1976 [SE] Sweden ..... 7607230

[51] Int. Cl.[2] ..... B66F 9/22

[52] U.S. Cl. ..... 414/729; 137/355.17; 212/268; 414/718

[58] Field of Search ..... 214/1 R, 131 R, 141, 214/653, DIG. 11; 212/55; 137/355.16, 355.17, 355.23, 355.24; 414/729, 718

[56] References Cited

U.S. PATENT DOCUMENTS

| | | | |
|---|---|---|---|
| 3,666,125 | 5/1972 | Gano et al. | 214/141 |
| 3,672,159 | 6/1972 | Sundin | 212/55 X |
| 3,807,108 | 4/1974 | Johnston | 212/55 X |
| 4,034,875 | 7/1977 | Pugh et al. | 214/141 |

*Primary Examiner*—Frank E. Werner
*Attorney, Agent, or Firm*—Karl W. Flocks

[57] ABSTRACT

The disclosure relates to a loading apparatus comprising an outer boom and an extension boom (telescopic boom), wherein the C-shaped bight of the hydraulic line, which bight extends in a rearward direction longitudinally of the outer boom and the telescopic boom, is housed in its entirety in a space defined by the walls of the telescopic boom and the outer boom and so arranged that, in all positions of the C-bight at the movements of the bight during extension and retraction of the telescopic boom, the opposite parts of the loop in the area of transition to the C-bight are defined by two relatively fixed walls situated between adjoining surfaces of the telescopic boom and the outer boom.

7 Claims, 4 Drawing Figures

LOADING APPARATUS WITH EXTENSION BOOM (TELESCOPIC BOOM) AND WITH HYDRAULIC LINES CARRIED BY THE BOOM

BACKGROUND OF THE INVENTION

1. Field of the Invention

This invention relates to loading apparatuses of the type comprising an outer boom and an extension boom (telescopic boom) telescopically extendable in the outer boom as well as at least one hydraulic line which extends with a flexible elastic portion from the outer boom to the telescopic boom in a sufficiently large bight-forming loop to permit maximum extension of the telescopic boom in relation to the outer boom.

2. Description of the Prior Art

Hydraulic lines extending from an outer boom past or via an extension boom in said outer boom to for instance operating cylinders for a grapple or like loading implement carried at the outer end of the extension boom always prove difficult to arrange in a simple manner and at the same time in such way that the lines are well protected and can be extended and retracted without being damaged at the retraction and extension movements of the telescopic boom.

A common type of loader in which problems of this kind often occurs is the two section knuckle boom. To permit increasing the reach of the boom system the outer boom is usually made extendable by means of an extension boom or telescopic boom, in which case the grapple or like loading implement is carried at the outer end of the telescopic boom. The first section of the boom and the outer boom as well as the telescopic boom are usually box beams. A hydraulic cylinder mounted within the first boom section and the telescopic boom usually serves as means for extending and retracting the telescopic boom (which may be divided into several telescoping sections). The hydraulic lines to be connected to said cylinder extend from the first boom section usually externally past the joint between the first boom section and the outer boom and run into said outer boom, but in addition the hydraulic lines must extend from the outer boom to the lifting implement carried by the telescopic boom. The last-mentioned hydraulic lines must be of a length permitting maximum extension of the telescopic boom. When the telescopic boom is retracted these lines consequently are too long and form bights.

In this type of knuckle booms the problem of running the hydraulic lines has been solved in many different ways. In the simplest solutions, flexible hydraulic hoses extend from the outer boom beneath the telescopic boom and via the front end of said telescopic boom to the loading implement. Upon retraction of the telescopic boom said hoses are allowed to place themselves in entirely deliberate depending bights with the ensuing risk that they will obstruct operation and may easily be damaged. More complex and expensive arrangements include protective pipes and guides for flexible hose sections or telescopically extendable pipes which are exposed to wear and give rise to sealing problems.

It may seem obvious to place the hydraulic lines well protected within or without the first boom section and the outer boom since it is prior art and conventional to place the hydraulic lines protected within the first boom section and also within the outer boom when said outer boom is not telescopically extendable. However, it is by far simpler to arrange hydraulic lines in a well protected location in knuckle boom systems having boom sections of constant length than in telescopically extendable boom sections, and so far no solution has been suggested, that can be considered satisfactory in view of both the requirement for simplicity and low cost and the requirement for protection against damage and wear.

SUMMARY OF THE INVENTION

The present invention therefore has for its object to provide an apparatus which satisfactorily meets these requirements and in which the C-shaped bight of the hydraulic line, which bight extends in a rearward direction longitudinally of the outer boom and the telescopic boom, is housed in its entirety in a space defined by the walls of the telescopic boom and the outer boom and so arranged that, in all positions of the C-bight at the movements of the bight during extension and retraction of the telescopic boom, the opposite parts of the loop in the area of transition to the C-bight are defined by two relatively fixed walls situated between adjoining surfaces of the telescopic boom and the outer boom.

BRIEF DESCRIPTION OF THE DRAWINGS

Embodiments of the invention will be more fully described hereinbelow with reference to accompanying drawings in which.

DETAILED DESCRIPTION OF THE PREFERRED EMBODIMENTS

Figure 1:
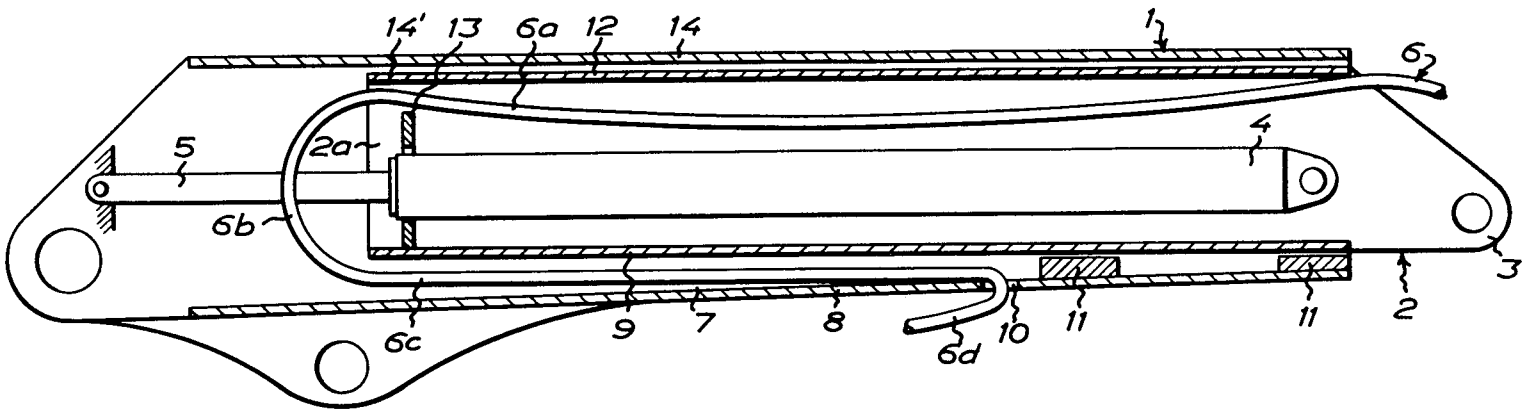
FIG. 1 is a longitudinal sectional view of a knuckle boom including an outer boom and an extension boom telescopically movable therein and containing hydraulic lines arranged in accordance with the present invention.

In the embodiment of FIG. 1 the outer boom 1 of a loading apparatus of prior-art design, is shown by way of example. The loading apparatus includes in addition to the outer boom a first boom section (not shown) to which the outer boom is pivoted. The outer boom 1 is in the form of a box beam, and an extension boom is movably arranged in the outer boom. In a loading apparatus of the kind indicated the extension boom is usually termed telescopic boom and is adapted to carry at its front end (at 3) a loading implement (not shown) operated by hydraulic cylinders, not shown. The telescopic boom 2 is movable in the outer boom 1 by means of a hydraulic cylinder 4 whose piston rod 5 in the embodiment illustrated is rearwardly directed for a reason that will appear from the following.

The hydraulic connection to the hydraulic cylinder 4 is provided in a conventional manner, which is not, however, illustrated and neither described since the invention is directed to the problem of running the lines to the operating cylinders of the loading implement, which in the embodiment illustrated are assumed to require four hydraulic lines 6. For the sake of simplicity only one of these four lines is shown in FIG. 1.

The most usual way of arranging the hydraulic connections with the loading implement is to use hoses which extend from a point midway between the two ends of the outer boom in large depending bights to a fastening at the front end of the telescopic boom. The hose bights must be of a sufficiently long length to allow maximum extension of the telescopic boom without using a stretching tension in the hydraulic hoses. These depending hose bights which can be found in most, for instance, vehicle-mounted booms of the type herein contemplated are very vulnerable and very cumbersome to the operation of the booms, for example in forest land.

According to the invention, however, each hydraulic hose 6 is laid in a single loop within the outer and telescopic booms, and the arrangement is such that the bight formation and the hose movement take place in a predetermined manner.

As illustrated in FIG. 1, the hose 6 extends in a long loop into the open front end of the telescopic boom 2, through said telescopic boom and from said boom into the outer boom 1 where the hose forms a C-shaped bight. From this bight the hose extends in a direction back towards the front end of the telescopic boom in a space 7 between the adjoining lower walls 8, 9 of the outer and telescopic booms, protruding through an opening 10 in the wall 8 of the outer boom. From the opening 10 the hose can extend along the outer boom towards the rear end thereof, for instance through a protective pipe (not shown) fixed to the underside of said outer boom. In FIG. 1 the hose bight portions located in the booms are designated *6a*, *6c* and the bight proper is designated *6b*, while the hose portion extracted through the opening 10 in the outer boom is designated *6d*. To provide the space 7 between the telescopic boom and the outer boom the telescopic boom is carried at a distance from the lower wall 8 of the outer boom by means of a pair of sliding and supporting bearings (alternatively rollers) 11 in the front end portion of the outer boom in a manner that will appear from FIG. 1. The opening 10 is provided near the rear one of said bearings 11. The hose 6 extends about the cylinder 4 in the longitudinal direction thereof, the hose bight *6b* being placed laterally of the piston rod 5. With four hoses 6, two hose bights *6b* should be placed on one side of the piston rod 5 and the other two hose bights on the other side of the piston rod. To provide as ample a room as possible for these hose bights, that is laterally of the piston rod, the cylinder is placed in an entirely reversed position relative to its normal position.

The configuration of each hose bight *6b* is determined by the room available for the loop run portions closest to the bight between the upper wall 12 of the telescopic boom 2 and the lower wall 8 of the outer boom 1. When the telescopic boom 2 is extended the cylinder 4 takes part in the movement of said telescopic boom. Also the hose bight *6b* takes part in the movement of the telescopic boom but is only moved half the distance, that is the distance between the bight *6b* and the rear end *2a* of the telescopic boom 2 increases when the telescopic boom is extended, simultaneously as the bight *6b* (under rolling movement of the hose) is moved to the right in FIG. 1. When the telescopic boom is wholly extended the bight *6b* lies in a more free position in the outer boom 1 between the lower and upper walls 7 and 14 thereof. In this position, the elastic hose bight *6b* may have a slightly greater radius but still has substantially the same configuration. Upon retraction of the telescopic arm the inner end portion 14' of the upper wall 14 of the telescopic boom slides along the upper run *6a* of the hose back to the position shown in FIG. 1. If desired, said wall portion 14' can be formed or provided with a smooth surface which reduces the wear of the hose.

It should be observed that the hoses 6 can be fixed in the telescopic boom 2 along the outer portions of the loop runs *6a*, *6b* which are not involved in the rolling movement of the hoses at the shifting of the hose bights *6b* when the telescopic boom 2 is being extended to the maximum extent. If desired, guides may be provided on the inner side of the wall 12 of the telescopic boom and on the outer side of the opposite wall 9, but this normally is not necessary since the piston rod 5 and the side walls of the outer boom 1 provide a sufficient lateral guiding of the hose bights *6b*. FIG. 1 shows at 13 a device for keeping the cylinder 4 centered at the rear end relative to the telescopic boom 2, and this device can be exploited for guiding the upper run *6a* of the hose 6.

Figure 2:
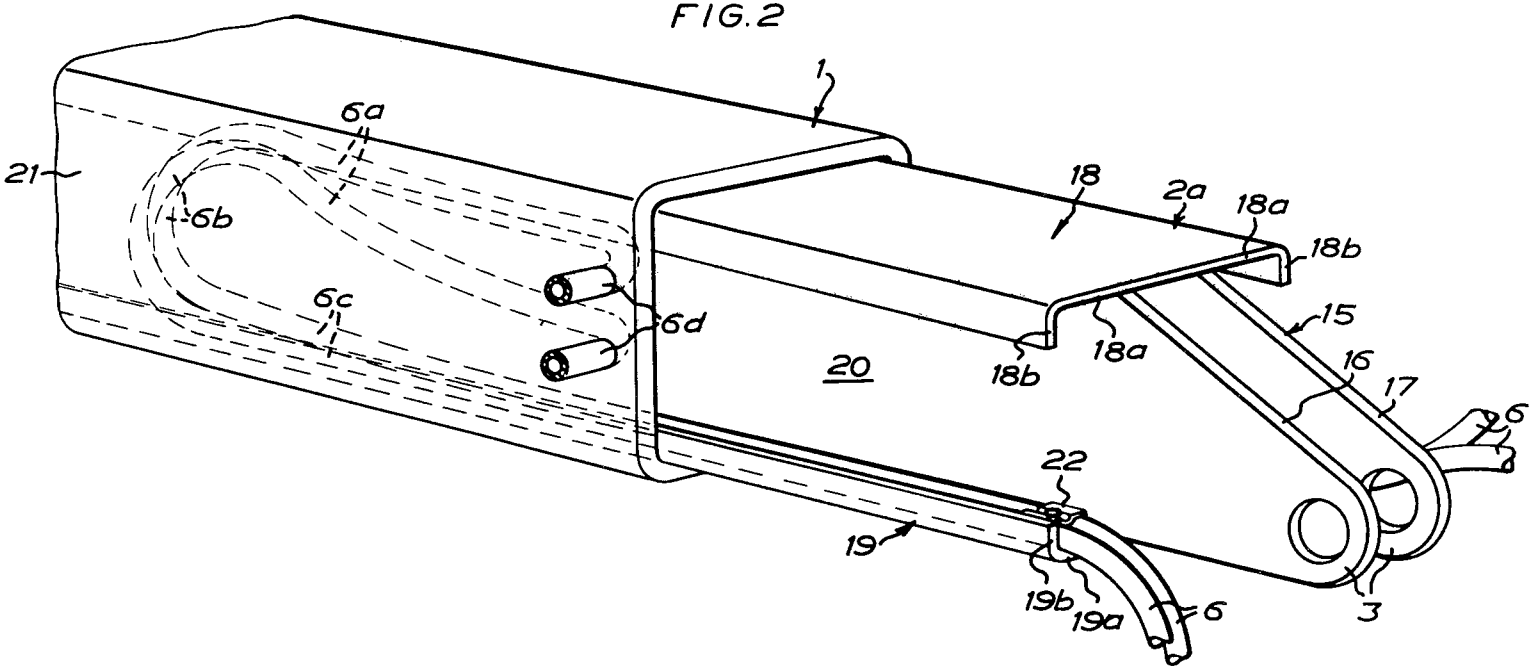
FIG. 2 is a perspective view of the outer end portion of a box beam type outer boom and an extension boom telescopically movable therein, said extension boom being of modified I-section in order to permit placing the hydraulic lines, in conformity with a preferred embodiment of the invention, in protective channels defined by the flanges of the I-section.

FIG. 2 shows a preferred embodiment of the invention in which the outer boom 1 as in FIG. 1 is in the form of a box beam, while the telescopic boom *2a* is in the form of a beam of modified I-section, more particularly II-section, that is the web of the I-section is in the form of a box beam 15 having spaced parallel side walls 16, 17 and upper and lower walls 18, 19 which on either side of the box beam section 15 have laterally protruding flanges *18a*, *19a* whose edge portions *18b*, *19b* are directed towards the horizontal center plane of the telescopic boom. The side walls 16, 17 and the flanges *18a*, *19a* and their bent edge portions *18b*, *19b* thus on either side of the box beam section 15 form a laterally outwardly open channel 20 which is closed by the adjoining side wall 21 of the outer boom 1 in that portion of the telescopic boom *2a* which is located within the outer boom 1. The hydraulic lines 6 coming from the loading implement (not shown), which are say four in number and are flexible hoses, are placed in pairs in the two channels 20 and preferably rest against the lower flanges *19a*. Each hose 6 forms like in FIG. 1 a loop which, however, extends rearwardly along the channel 20 and forms a bight *6b* in the channel within the outer boom 1, that is in the space between the channel 20 and the adjoining outer boom wall 21. From the bight *6b* each hose 6 extends forwardly and is drawn outwardly through the outer boom wall 21 in an area between the flange edges *18b*, *19b*, as will be clearly seen from FIG. 2 where the outer portions of the hoses are designated *6d*. From there the hoses extend rearwardly (not illustrated) along the outer boom 1 either in protective pipes or externally located. The configuration and size of the flexible, but relatively rigid hose bights *6b* are determined by the distance between the flanges *18a*, *19a* of the telescopic boom *2a* and are practically constant during the shifting of the bights when the telescopic boom is being operated. When the telescopic boom *2a* is extended to its maximum extent the hose bights *6b* can still be located entirely within the channel 20.

Also in the embodiment shown in FIG. 2 the telescopic boom *2a* is movable by means of a hydraulic cylinder which in this instance is placed in the outer boom 1 and penetrates into the box beam section 15 of the telescopic boom 2*a*, in which case the piston rod can be directed forwardly. Said cylinder is not, however, illustrated in FIG. 2.

The portions of the hoses which need not be movable relative to the telescopic boom 2*a* can be fixed by means of clamps 22 in the channels 20, for instance in the manner that will appear from FIG. 2.

Figure 3:
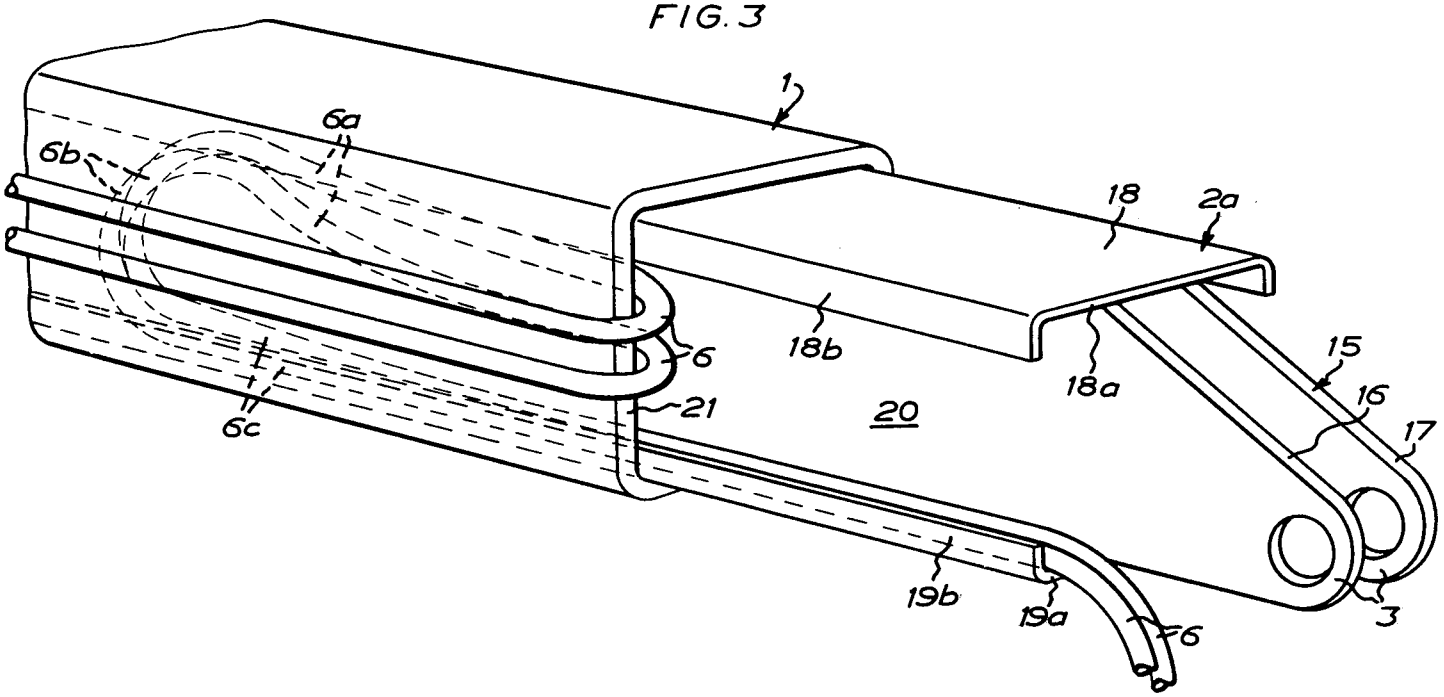
FIG. 3 is a modification of FIG. 2.

FIG. 3 illustrates an embodiment which differs from that in FIG. 2 only by the fact that the hydraulic hose lines 6 extend from outside into the space between the channels 20 and the side walls 21 of the outer boom 1, in which space the hoses form bights 6*b*.

Figure 4:
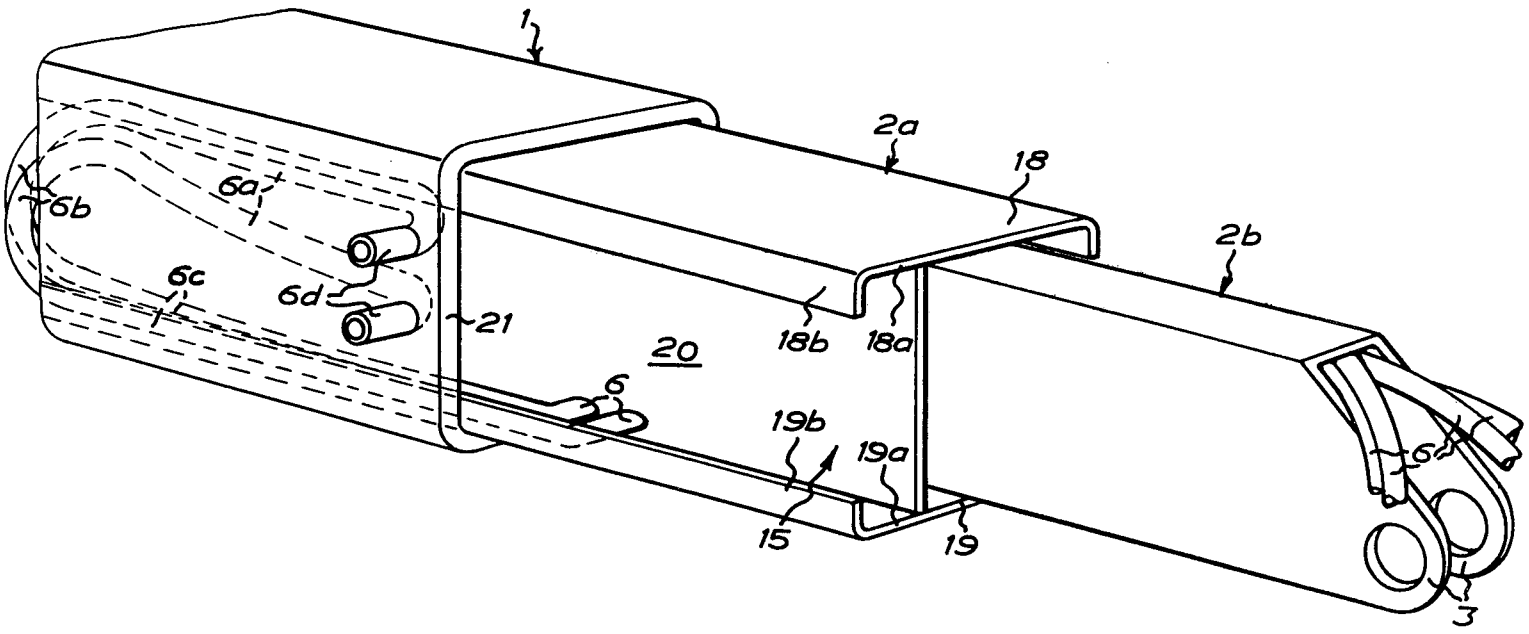
FIG. 4 is an embodiment of the invention which is a combination of the embodiments in FIGS. 1 and 2 and is applied to a boom system in which the telescopically extendable boom comprises two relatively telescoping boom sections.

In the embodiment shown in FIG. 4 the telescopic boom comprises two relatively movable boom sections 2*a*, 2*b* of which one boom section 2*a* corresponds to the telescopic boom 2*a* in FIG. 2 while the other inner boom section 2*b* corresponds to the telescopic boom 2 in FIG. 1. The hydraulic hoses 6*b* are arranged according to a combination of FIG. 1 and FIG. 2, that is the hydraulic hoses 6 in the inner extension boom 2*b* are arranged in bights according to FIG. 1, passed outwardly through the side wall of the outer telescopic boom section 2*a* to the respective channel 20 and extend along the channel inwardly of the outer boom 1 where they form bights 6*b* in the space defined by the channel and the side wall 21 of the outer boom 1, the hydraulic lines being drawn outwardly through the side wall 21, as shown at 6*d*.

As compared with the embodiment illustrated in FIG. 1 the embodiment of FIG. 2 provides the further great advantage that the telescopic boom section by reason of its side flanges ensures a very satisfactory protection of the hydraulic lines and adequately guides the bight formation of the hoses simultaneously as the channel-shaped flanges in combination with the central box beam profile confer a very great resistance to the telescopic boom—considering its relatively lightweight construction—to all cases of loading since the section as a whole has its bending and torsion-rigidifying wall material placed in an optimum manner simultaneously as the hollow space in the central box beam profile provides room for a hydraulic cylinder for the operation of the telescopic boom; this hydraulic cylinder cannot ever come in contact with the hoses.

What I claim and desire to secure by Letters Patent is:

1. A telescopically extensible boom loading apparatus comprising an outer hollow boom section, an inner boom section in telescopic relationship in said boom, and at least one flexible hydraulic hose extending with a flexible section from said outer hollow boom section to said inner telescopic boom section, said flexible hose being of sufficient length to permit maximum extension of the inner telescopic boom section in relation to the outer boom section and forming a loop having a pair of opposite legs and a substantially C-shaped bight extending from and connecting each of said legs to the other, and further extending in a longitudinal direction in said telescopically extensible boom, one of said loop legs being shortened and the other lengthened, and vice versa, and the C-bight being moved longitudinally in the boom when the boom sections are extended and retracted, wherein said inner boom section comprises a longitudinally web and at least one protruding flange forming a guide and spacer means for guiding the inner boom section in the outer hollow boom section with the web of the inner boom section in spaced relation to at least one inner side of the outer boom section, the said inner side of the hollow outer boom section and said web and flange of the inner boom section forming, when the inner boom section is retracted in the outer boom section, an open ended channel; and wherein said loop with its C-bight are housed in said channel between the said inner side of said outer boom section and the said web of the inner boom section with one of the legs of said loop of the flexible hose being seated on the protruding flange.

2. A loading apparatus as claimed in claim 1, wherein the inner boom section is in the form of a box beam profile with protruding flanges which define on the outer side of each of two of the four sides of the box beam profile pairwise an outwardly opened channel which in the part of the inner boom section which is situated in the outer boom section is closed by an adjoining wall of said inner boom section, and wherein the hydraulic hose loop is arranged in said channel and extends rearwardly into the space closed by said channel and said wall of said outer boom section.

3. A loading apparatus as claimed in claim 2, wherein the inner side of one of said flanges, that is one side wall of the channel, forms a supporting surface for one part of the hydraulic hose loop, which part extends to the outer end of said inner boom section and wherein the inner side of the other flange forms a supporting surface for at least that portion of the other part of the loop which is situated closest to the C-bight of the loop.

4. A loading apparatus as claimed in claim 2, wherein said inner boom section of box profile is rectangular along at least the major portion of its length and the two flanges are formed on opposite walls by longitudinal edge portions protruding from the other two opposite walls, said edge portions forming at the opposite long sides of said inner boom section together with the other two long walls channels which are substantially of U-shaped section, and the outer edge portions of the flanges being on each side bent inwardly towards one another so that the U-section resembles a C-section.

5. A loading apparatus as claimed in claim 4, wherein opposite wall surfaces are formed by the opposite sides of a box beam profile portion of said outer boom section and said inner boom section.

6. A loading apparatus as claimed in claim 5, wherein a hydraulic cylinder for moving said inner boom section in relation to the outer boom section is placed within the inner boom section said cylinder having a piston rod extending rearwardly within said outer boom section, and wherein the hydraulic hose bight is arranged in a space between the piston rod and the inner side of an adjoining wall of said inner boom section and said outer boom section.

7. A loading apparatus as claimed in claim 6, wherein the hydraulic hose loop has its one part arranged on the inner side of a bottom wall of said outer boom section and wherein the inner boom section is guided in said outer boom section so that one side of said inner boom section and said inner side of said outer boom section defined a space in the area of said one hydraulic hose part when the inner boom section is retracted into said outer boom section.

* * * * *